US006517912B1

(12) United States Patent
Morfill et al.

(10) Patent No.: US 6,517,912 B1
(45) Date of Patent: Feb. 11, 2003

(54) PARTICLE MANIPULATION

(75) Inventors: Gregor Morfill, München (DE); Hubertus Thomas, Pfaffenhofen (DE); Timo Stuffler, Seefeld (DE); Uwe Konopka, Neufahrn (DE)

(73) Assignees: Max-Planck-Gesellschaft zur Forderung der Wissenschaften e.V. (DE); Kayser-Threde GmbH (DE)

( * ) Notice: Subject to any disclaimer, the term of this patent is extended or adjusted under 35 U.S.C. 154(b) by 0 days.

(21) Appl. No.: 09/402,295

(22) PCT Filed: Apr. 2, 1998

(86) PCT No.: PCT/EP98/01938

§ 371 (c)(1),
(2), (4) Date: Nov. 29, 1999

(87) PCT Pub. No.: WO98/44766

PCT Pub. Date: Oct. 8, 1998

(30) Foreign Application Priority Data

Apr. 2, 1997 (DE) ..... 197 13 637

(51) Int. Cl.[7] ..... H05H 1/02; H05H 1/24; H05H 1/46

(52) U.S. Cl. ..... 427/570; 427/572; 427/569; 427/212; 216/71

(58) Field of Search ..... 427/569, 572, 427/570, 212; 216/67, 71

(56) References Cited

U.S. PATENT DOCUMENTS

| | | | | |
|---|---|---|---|---|
| 5,102,496 A | * | 4/1992 | Savas | 134/1.1 |
| 5,108,543 A | | 4/1992 | Suzuki et al. | |
| 5,252,954 A | | 10/1993 | Nagata et al. | |
| 5,401,356 A | * | 3/1995 | Enami et al. | 427/569 |

(List continued on next page.)

FOREIGN PATENT DOCUMENTS

| | | |
|---|---|---|
| DE | 37 29 347 C2 | 3/1988 |
| DE | 0 303 510 A2 | 2/1989 |
| DE | 40 18 954 C2 | 1/1991 |
| DE | 41 18 072 A1 | 12/1992 |
| DE | 195 38 045 C1 | 1/1997 |
| EP | 0 186 910 B1 | 7/1986 |
| EP | 43 16 349 A1 | 11/1994 |
| WO | WO 88/06194 | 8/1988 |

OTHER PUBLICATIONS

W.H. Steel "The movement of Dust Particles in a Plasma by means of a Laser Beam", IEE Half–Day Colloquium in Dust Plasmas (Ref. #1998/267), London, UK (3 pages labled 2/1–2/3) Mar. 1998.*

Bingham et al., "The Attraction of Dust Grains in a Plasma and the formation of Agglemerates": IEE Half–Day Colloquium on Dust Plasmas, London, UK (3 pages, Labled 4/1–4/3) Mar. 1998.*

Chu et al, "Coulomb Lattice in a weekly ionized collordal plasma", *Physica*A 205, No. 1–3, p. 183–190 Apr. 1994.*

Law et al, "Dust Particle Interaction in RF Plasma Sheaths", 1996 13$^{th}$ European Sectional Conference on the Atomic & Molecular Physics of Ionized Gases., vol. 20E, part A, p. 187–188 1996 (no month).*

(List continued on next page.)

*Primary Examiner*—Marianne Padgett
(74) *Attorney, Agent, or Firm*—Schnader Harrison Segal & Lewis LLP

(57) ABSTRACT

In a method for manipulating particles arranged in a plasma-cristalline state in a plasma of a carrier gas, the particles are at least partially subject to plasma treatment and/or applied to a substrate surface. A device for manipulating of particles in plasma-cristalline state includes a reaction vessel, in which plasma electrodes and at least one substrate are situated. An adaptive electrode for formation of a location selective low frequency or static electrical field in the reaction vessel is described.

30 Claims, 10 Drawing Sheets

U.S. PATENT DOCUMENTS

| | | | | | |
|---|---|---|---|---|---|
| 5,433,258 | A | * | 7/1995 | Barnes et al. | 427/569 |
| 5,456,796 | A | * | 10/1995 | Gupta et al. | 427/569 |
| 5,494,523 | A | * | 2/1996 | Steger et al. | 427/569 |
| 5,543,184 | A | * | 8/1996 | Barnes et al. | 427/569 |
| 5,573,597 | A | * | 11/1996 | Lantsman | 216/71 |
| 5,609,690 | A | | 3/1997 | Watanabe et al. | |
| 5,637,190 | A | * | 6/1997 | Liao | 134/1.2 |
| 5,693,179 | A | * | 12/1997 | Blackburn et al. | 216/67 |
| 5,693,238 | A | * | 12/1997 | Schmitt et al. | 216/67 |
| 5,746,928 | A | * | 5/1998 | Yen et al. | 134/1.1 |
| 5,854,138 | A | * | 12/1998 | Roth et al. | 216/67 |

OTHER PUBLICATIONS

M. Aints et al., *Propagation Velocities of the Pint–Electrode HF Discharge,* Fifth International Sysmposium on High Voltage Engineering, Braunscheweig, Aug. 1987, pp. 14.21/1–3, vol. 1.

M. Aints et al., *Propagation of a HF Point–Discharge at Frequencies of 10–20 MHz*, Eighth International Conference on Gas Discharges . . . , Sep. 1987, pp. 398–401.

H. Thomas et al., *Plasma Crystal: Coulomb Crystallization in a Dusty Plasma*, Physical Review Letters, Aug. 1994, vol. 73, No. 5, pp. 652–655.

Hubertus M. Thomas et al., *Melting Dynamics of a Plasma Crystal*, Nautre, Feb. 1996, vol. 379, pp. 806–809.

D.M. Tanenbaum et al., *Nanoparticle Deposition in Hydrogenated Amorphous Silicon Films During RF Plasma Deposition*, Appl. Phys. Lett., Mar. 1996, vol. 68, No. 12, pp. 1705–1707.

R. Roca i Cabarrocas et al., *Nanostructured Silicon Thin Films: A New Material For Photovoltaics?*, 14$^{th}$ European Photovoltaic Solar Energy Conference, Barcelona, Jun.–Jul. 1997, Paper No. P5A.20.

S. Hamaguchi et al., *Triple Point of Yukawa Systems*, Physical Review E, vol. 56, No. 4, Oct. 1997, pp. 4671–4682.

*The Movement of Dust Particles in a Plasma by Means of a Laser Beam*, IEE Half–Day Colloquium on Dusty Plasmas, London, Mar. 1998, Database Inspec Institute of Electrical Engineers, Stevenage, GB, Inspec No. 5907036 Abstract only.

*The Attraction of Dust Grains in a Plasma and the Formation of Agglomerates*, IEE Half–Day Colloquium on Dusty Plasmas, London, Mar. 1998, Database Inspec Institute of Electrical Engineers, Stevenage, GB, Inspec No. 5907038 Abstract only.

* cited by examiner

PARTICLE MANIPULATION

FIELD OF THE INVENTION

The invention concerns a method and a device for manipulating microscopic particles, especially for manipulating particles in a plasma-crystalline state.

BACKGROUND OF THE INVENTION

It is known that microscopic solid particles in a plasma may be oriented in a macroscopically regular arrangement as so-called plasma crystal. The properties of plasma crystals are for instance described by H. Thomas et al. in "Phys. Rev. Lett.", Volume 73, 1994, page 652 ff., or by H. Thomas & G. E. Morfill in "Nature", Volume 379, 1996, page 806 ff.

A quantitative description of plasma crystals on the basis of molecular-dynamic simulations of Yukawa systems and delimitation with respect to "liquid" states is described by S. Hamaguchi et al. in "Physical Review E", Volume 56, 1997, p. 4671 ff. This publication was published after the priority date of the present application. The delimitation between a plasma-crystalline and a non-plasma-crystalline (for instance liquid) state is performed on the basis of a phase diagram, whose abscissa is formed by a dimensionless parameter $\kappa$ as quotient from the charge-dependant distance between particles and the so-called Debye length and its ordinate is formed by a parameter $\Gamma$, which dimensionless describes the coulomb interaction of the particles. Because the abscissa and ordinate parameters depend on the operating parameters of the plasma, therefore changes in state of the plasma states of the particles may be achieved by changes in operating parameters.

Important aspects of plasma crystal formation will hereinafter be explained with reference to a conventional arrangement for formation of a plasma crystal according to FIG. 14.

In a plasma state, which is for instance created by glow discharge or gas discharge, a gas includes differently charged particles, like positively or negatively charged ions, electrons and radicals, but also neutral atoms. If there are microscopic particles in the plasma (order of magnitude: $\mu$m), for instance dust particles, then these are electrically charged. The charge may be up to some hundred thousands of electron charges, depending on the particle size and the plasma conditions (gas type, plasma density, temperature, pressure, etc.). Under suitable particle and plasma conditions, coulomb forces are generated between the charged particles, under which effect the particles take a plasma crystalline state as a two or three dimensional arrangement. Besides the coulomb forces, an energy reduction at the particles by collision with neutral atoms within the plasma has an effect.

An arrangement for formation of plasma crystals is by example shown in FIG. 14 (also see the above mentioned publication in Phys. Rev. Lett.). In a reactor (vessel walls not shown) with a carrying gas, two plane discharge electrodes are arranged one over the other. The lower circular or disc-shaped HF electrode 11 is fed with an alternating voltage, and the upper, ring-shaped counterelectrode 12 is for instance grounded. The distance between the electrodes amounts to about 2 cm. A control circuit 13 is installed for connecting the HF generator 14 to the HF electrode 11 and to feed the grounding and separating circuit 15 of the counterelectrode 12. The high frequency energy may for instance be coupled in at a frequency of 13.56 MHz and a power of about 5 W. The carrying gas is formed by inert gases or reactive gases under a pressure of about 0.01–2 mbar. By means of a dust dispenser (not shown), dust particles are introduced into the reactor. The dust particles arrange themselves as a plasma crystal in a balanced condition, in which the gravitation force G effecting the particles are counterbalanced by the electrical field force E, which has an effect on the particles near the HF electrode 11 depending on their charge. If this is a mono dispersed dust grain distribution, then the plasma crystal arrangement is either performed as a mono layer in a plane, or as a multi-layer state when forming 3-dimensional plasma crystals. The plasma crystal is detectable by the naked eye under light up to a particle size of about 1 $\mu$m. The visibility of the plasma crystal is improved by a helium-neon laser 16, arranged laterally, whose beam is fanned out to a diameter of about 150 $\mu$m to the size of the lateral crystal dimension using a cylinder lens combination 16*a*. Observation of the plasma crystal is performed using a CCD camera 17, which is fitted with an enlarging macro optics 18 and controlled by image processing 19, which is also connected to the laser 16.

The behaviour of microscopic particles in plasma is of great theoretical and practical interest. The theoretical interest especially concerns the plasma crystals and their change of state. The practical interest is derived from the fact that plasma reactors employed for coating or processing procedures (especially in semiconductor technology) have an electrode structure according to FIG. 14.

In prior arrangements for examination of plasma crystals, the means for influencing the plasma crystals were limited to the type of particles used and the plasma conditions realized. A means for deliberate and location-selective handling of plasma crystals is currently not available, so that up to now no practical use for plasma crystals was known.

OBJECT OF THE INVENTION

An object of the invention is to provide a method for manipulating particles in plasma, especially for influencing particles themselves or for modification of a substrate surface and a device for realizing the method.

SUMMARY OF THE INVENTION

The invention is based on the following basic findings. The properties of a plasma crystal, especially the geometric shape, does not only depend on the properties of the plasma more over or the particles. Moreover, it is possible to modify the shape of a plasma crystal, especially the shape of the outer edge or the cross sectional shape, by a location-selective effect on the above mentioned balance between gravitational forces and electrical forces. For this purpose, the external forces having an effect on the particles, for instance by a location-dependent change of a static, quasi-static or low frequency changing electrical field between the electrodes of a plasma reactor are varied by location-selective particle discharge or by location-selective particle irradiation (effect of adjusting forces). In this manner, particles in a plasma may be arranged on any curved plane with any edge in a plasma-crystalline state. The particles in the plasma may therefore be moved in a predetermined manner, whereby this movement is reversible, so that the plasma-crystalline state may even be switched between different shapes.

Another important aspect of the invention consists of the fact that by location-selective deformation of a plasma crystal, different parts of the plasma crystal are subject to different plasma conditions. This especially enables, in a plasma between two essentially plane electrodes, location-selective plasma treatment of parts of the plasma crystal (for instance coating or ablation). Such a location-selective particle treatment may be followed by deposition on a substrate.

Furthermore, an important aspect of the invention consists of the fact that formation of a plasma-crystalline state remains uninfluenced by the presence of a substrate in a plasma reactor, especially between reactor electrodes for creation of a glow discharge or gas discharge. It is especially possible to perform the above mentioned switching processes in the immediate vicinity of an areal, plane or curved substrate and subsequently reduce the distance between the particles in a plasma-crystalline state and the substrate surface in such a manner that at least a predetermined part of the particles is applied to the substrate surface. The reduction of the distance may be performed either by influencing the field forces holding the particles in position or by movement of the substrate surface. Therefore particles in a plasma-crystalline state may be deposited on substrate surfaces in patterns of any design. Therefore, the invention provides for a new, location-selective, mask-free coating Method creating modified surfaces. Due to the particles applied, the modified surfaces have changed electronic, optical and/or mechanical properties. But it is also possible to use the location-selectively applied particles themselves for masking or conditioning of the substrate surface before a subsequent further coating step.

A device according to the invention for manipulating of particles in plasma-crystalline state includes a reaction vessel containing devices for forming a plasma and at least one substrate. The devices for forming the plasma are preferably formed by planar, essentially parallel electrodes, in whose distance the substrate is movable. The electrodes within the reaction vessel may have field-shaping structures for location-selective influence of particles in plasma-crystalline state. The reaction vessel may furthermore contain means for location-selective particle discharge (for instance UV exposure means with a masking device), means for exerting radiation pressure on the particles, observation means and a means of control.

A specific aspect of the invention is the design of the electrodes for location-selective influencing of the particles within the reaction vessel. According to the invention, an electrode device (or: adaptive electrode) is provided, which has a plurality of electrode segments, which are simultaneously fed with a high frequency voltage and in each case separately with a specific direct voltage or low frequency voltage. The high frequency voltage is adapted for the purpose of creating respectively preserving a plasma state within the reaction vessel, while the direct respectively low frequency voltage is adapted for creating a static or slowly changing field distribution within the reaction vessel, under whose effect the particles arrange or move within the reaction vessel. Further important characteristics of the adaptive electrode are formation of a matrix formed of miniaturized electrode segments (point electrodes), design of the matrix as essentially planar, layered component, whose electrode side points at the reaction vessel and whose back bears control electronics, pressure relief of the component, for instance by creation of a vacuum in the space to which the back of the electrode device points, and provision of a tempering device for control electronics.

BRIEF DESCRIPTION OF THE DRAWING

Details and advantages of the invention are described below under reference to the enclosed drawings, which show in.

DETAILED DESCRIPTION OF THE INVENTION

Figure 14:
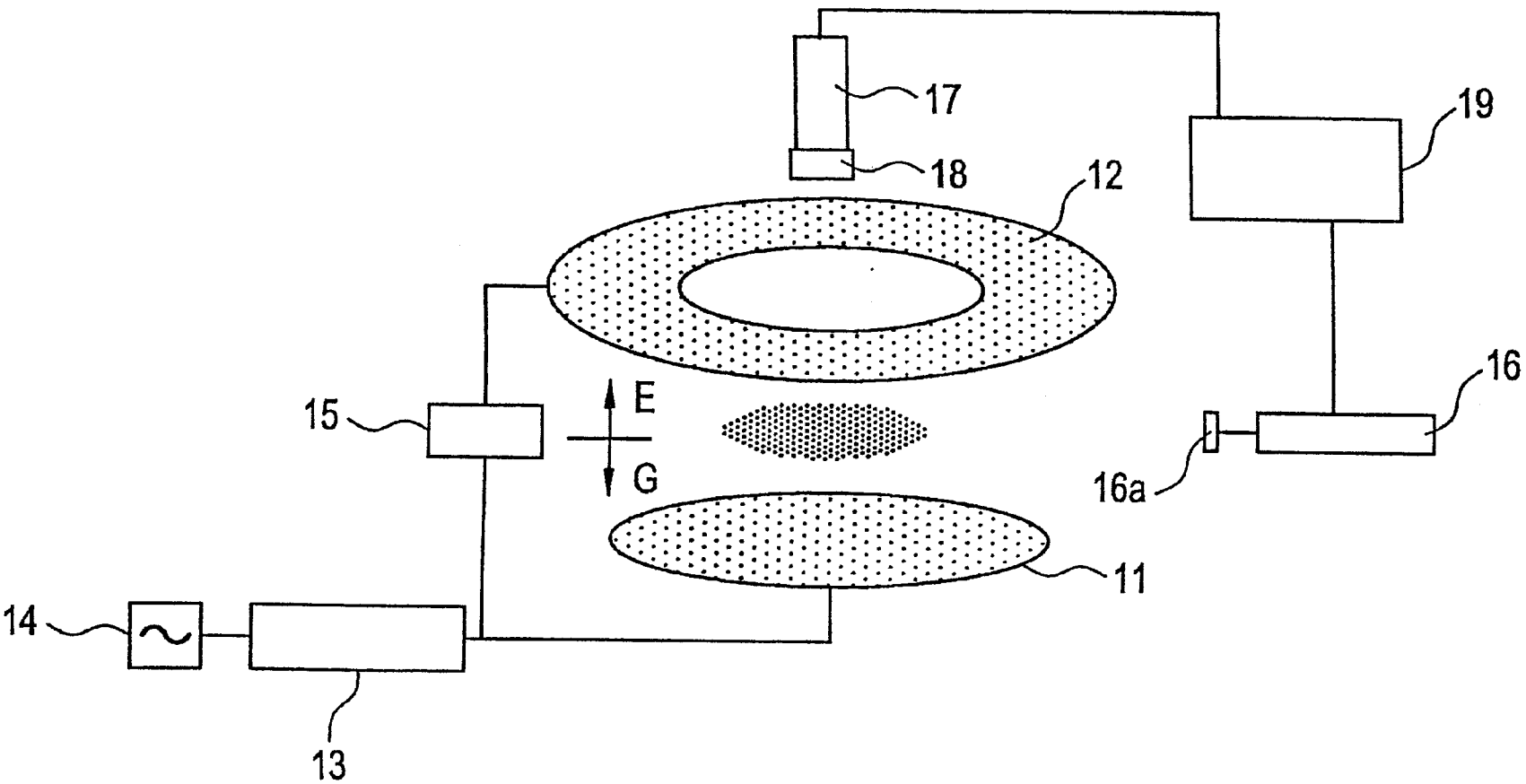
FIG. 14 PRIOR ART
FIG. 14 a schematic perspective view of a conventional reactor for forming plasma crystals (state of the art).

The invention is hereafter described using the example of a plasma installation, which as a reaction vessel includes a reactor, whose design with respect to plasma generation and plasma crystal monitoring essentially conforms to conventional design, as described above under reference to FIG. 14. But it is comprehensible to a skilled person that reactors of other designs may be used to the extent they are fitted for manipulating particles in a plasma-crystalline state according to the invention.

Figure 1:
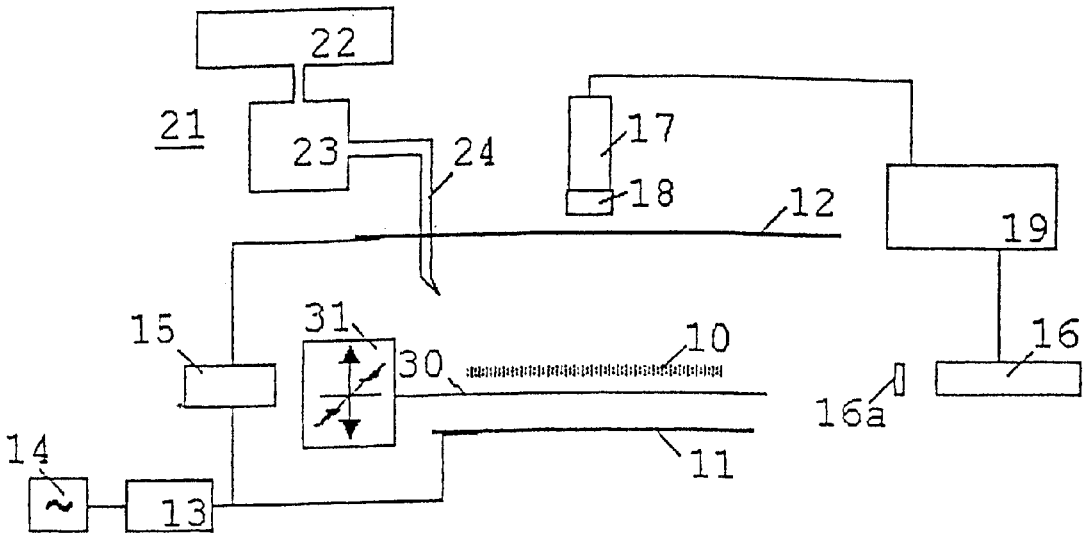
FIG. 1 a schematic side view of a device according to the invention for manipulating particles in a plasma-crystalline state.

The schematic side view of a device for manipulating plasma crystals according to FIG. 1 shows an HF electrode 11, a grounded counterelectrode 12, a control device 13, an HF generator 14, a switching device 15, a monitoring light source 16 including a cylinder lens device 16*a*, a means for observation in the form of a CCD camera 17 with enlarging optics 18 and an associated control device 19. In the case of very small (<100 nm) particles, another means for monitoring is required (for instance using Bragg scattering). A dust dispenser 21 with a reservoir 22, a conditioning device 23 and means for injection 24 is installed for moving particles into the space between the HF electrode 11 and the counterelectrode 12. The conditioning device 23 may for instance contain a precharging device for the particles.

The device according to the invention furthermore includes a substrate 30, which may be moved in any direction in space using an adjusting device 30. FIG. 1 does not show the walls of the reaction vessel forming an enclosed space for the carrying gas and hermetically encloses the electrodes 12, the substrate 30 and parts of the particle feed installation. The wall may furthermore have windows for coupling in respectively out of radiation.

Figure 2:
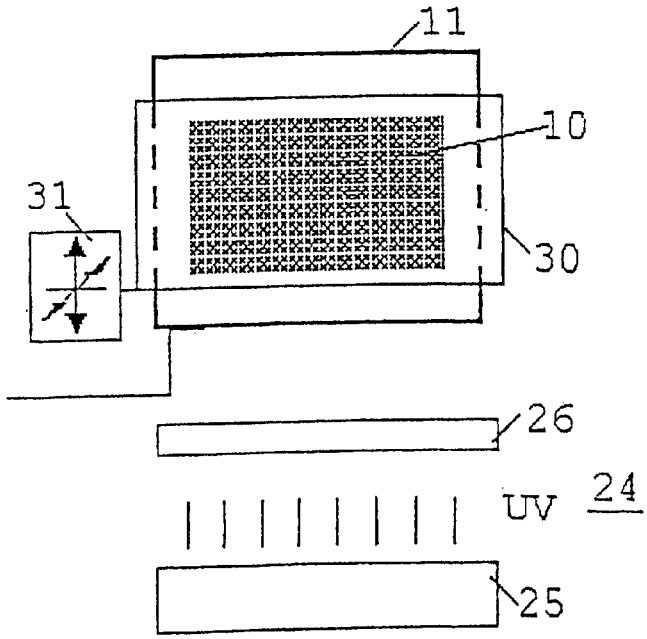
FIG. 2 a schematic top view of a part of the device according to FIG. 1.

FIG. 2 is a schematic top view onto parts of the device according to the invention in FIG. 1, namely the HF electrode 11 and the substrate 30 with the adjusting device 31. Additionally a discharge device 24 is shown, which is not shown in FIG. 1, which is adapted for ,location-selective discharge of particles in to plasma-crystalline state. For the example shown, the discharge device 24 includes a UV radiation source 25 and a display and masking system 26, by which parts of the plasma crystal are irradiated and may be discharged by effect of the UV radiation.

Below, a first embodiment of the method according to the invention for manipulating of particles within plasma with reference to FIGS. 1 and 2 is explained.

In the reaction vessel (not shown), especially between the HF and counterelectrode, which have the effect of discharge electrodes, a plasma is ignited in a carrier gas. A specific advantage of the invention is the fact that no specific requirements must be made of the type of carrier gas. The plasma conditions (type and density of the gas, HF power, frequency, pressure, etc.) may be selected by a skilled person according to the conditions of plasma design and the desired crystal properties. These may for instance be low energy argon discharges or silan discharges under the conditions as they are used for plasma depositing in semiconductor technology. The use of a reactive gas like for instance silan is advantageous for further treating steps on the plasma crystal. The energy of the ions within the plasma essentially corresponds to the gas temperature. It is determined by the discharge conditions and possibly by an external cooling installation. For instance, nitrogen cooling (not shown) may be provided for in a device according to the invention.

Using the dust dispenser 21, the particles to be manipulated are introduced into the electrode space. The particle size is in the range from 20 nm to 100 $\mu$m. The lower limit of the particle size is established by the pressure conditions within the reaction vessel and the charge. The particles must be so heavy that in plasma-free condition the particles perform a vertical movement under the effect of gravity and do not remain in suspended state. The upper limit for the particle size is established by the so-called Debye length between neighboring particles. The Debye length increases in proportion to the root of the plasma temperature respectively reciprocally proportionate to the root of the plasma density.

Another specific advantage of the invention consists in the fact that besides the size requirements made of the particles to be manipulated no further restrictions with respect to the shape or the material of the particles exist. Particles of any shape may be used, for instance round, pin-shaped, tubular or platelet-shaped particles. The particles must be solid and have sufficient shape stability under plasma conditions. Preferably a material is used which has specific electrical or optical properties within the interesting particle size range. It is also possible to use a material being composed of different substances, for instance organic materials.

The particles introduced into the plasma form a plasma crystal 10 (see FIGS. 1, 2). The plasma crystal is characterized by a plane, areal, regular particle arrangement. The particle arrangement may be a mono layer, as it is explained below with reference to FIG. 3, a multiple layer or a three-dimensional structure.

The HF electrode has a negative direct voltage. In the case of an electrode diameter of about 8 to 10 cm, an electrode distance of about 2 cm and a bias potential at HF electrode 11 of about −15 volts, for instance polymer particles of a characteristic size of about 7 $\mu$m arrange themselves as an areal cloud at a distance of about 0.5 cm from the HF electrode 11.

The dimensions stated here by example change accordingly for modified electrode parameters (electrode diameter, electrode distance, voltages). The electrode diameter may for instance be within the range of a few centimeters up to 60 cm and the electrode distance may be in the range of 1 cm up to 10 cm. Preferably, electrode parameters are selected which are compatible to the available CVD reactors.

The substrate 30 is located between the HF electrode 11 and the plasma crystal 10. It is also advantageous that there is no limitation with respect to the substrate material and the substrate shape. Especially a conductive as well as a non conductive substrate may be used without changing the conditions for plasma crystal formation.

In the case of a method for manipulating particles according to the invention, first adjustment of the particles into a treatment position is performed. This treatment position may conform to the balanced condition for forming the plasma crystal after introduction of the particles into the reactor. But it is also possible to move the plasma crystal 10, especially to change the relative position with respect to the electrodes or the substrate. This is for instance performed by a change in plasma conditions. For instance, by changing the carrying gas density and therefore the particle charge, it is possible to achieve a change in the balanced state between gravitation force and electrical force. The same holds true for a change of the negative bias voltage of the HF electrode or in the case of an external discharge of the particles. In the treatment position, in a next step, at least part of the particles will be subject to plasma treatment or application onto the substrate.

The plasma treatment may for instance include particle surface coating or ablation. In the latter case, for instance step-wise lowering of the plasma crystal to a lower height above the HF electrode may lead to the fact that the lower layers of the plasma crystal are subject to a selective plasma etching process. For particle coating, possibly an exchange of the plasma during current reactor operation may be provided for.

Any suitable change of the distance between the plasma crystal and the substrate surface may be used for deposition onto the substrate 30. According to a first alternative, the plasma crystal is lowered to the substrate by modification of the plasma conditions. According to a second alternative, the substrate is lifted to the plasma crystal using an adjusting device 31. According to a third, preferred, alternative, the discharge between the electrodes is switched off, so that the plasma is extinguished and the particles fall down onto the substrate. During contact between the particles and the substrate, molecular adhesive forces lead to adsorption of the particles on the substrate surface. In a further procedure, the particle adsorption may be increased by an overcoating.

Figure 3:
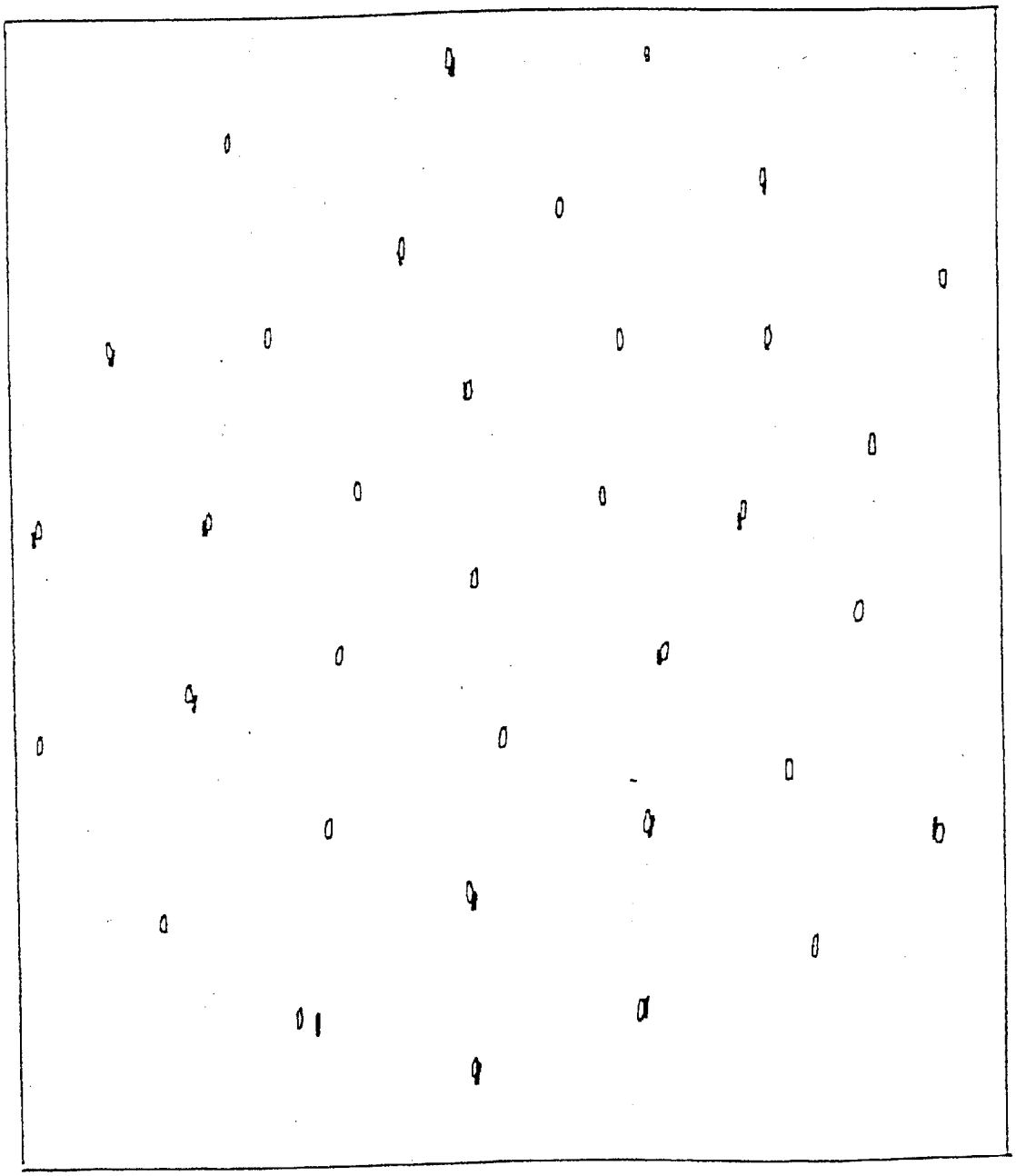
FIG. 3 a top view of a section of a plasma crystal in a free respectively adsorbed state for illustration of the coating technology according to the invention.

FIG. 3 shows by example the results of an especially simple deposition of particles to the substrate surface according to the third alternative stated above. A plasma-crystalline monolayer is shown, as it may be viewed using the image recording device 17, in a freely suspended state within the plasma (shapes with unfilled edges) and in an adsorbed state (shapes with filled edges) on a substrate after extinguishing the plasma. The particle dimensions are about 5 to 10 μm with distances of about 200 to 300 μm. The inventors have found for the first time that for this especially simple application of the particles onto the substrate the regular arrangement is almost completely preserved, as the minimal deviations between particle positions in suspended respectively adsorbed state show. Due to this characteristic, it is possible to place microscopic particles onto a substrate surface with high precision.

Figure 4:
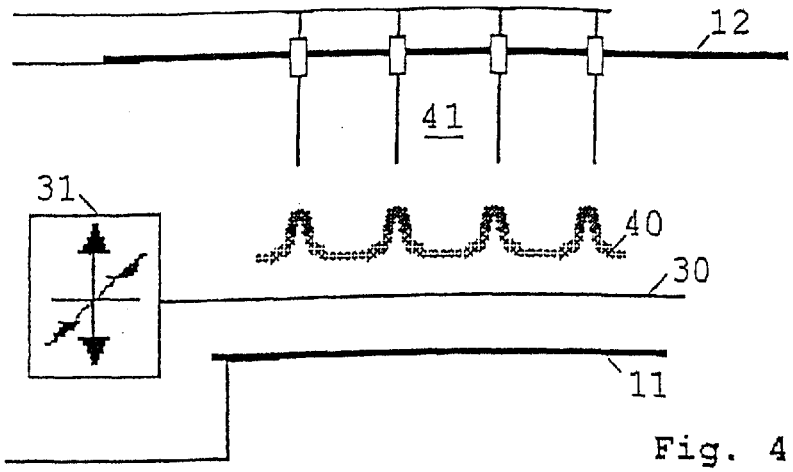
FIG. 4 a schematic illustration of a electrode design according to the invention for manipulating plasma crystals, and an example of a location-selective substrate coating.

FIG. 4 shows a schematic side view of a section of an arrangement for particle manipulation according to the invention. Between the HF electrode 11 and the substrate 30 with the adjusting device 31 on the one hand and the grounded counterelectrode 12, particles in plasma-crystalline state are arranged. The plasma crystal 40 has a multiple curved cross section shape, which essentially conforms to the shape of the static electric field in the space between the electrodes. The field between the electrodes is deformed location-selectively by electrode structure 41. In the case of the example shown, electrode structuring is made by means of additional electrodes 41 (needle electrodes), which are biased with a positive voltage and led insulated through the counterelectrode 12. The plasma crystal follows the location-selective deformation of the electrical field so that the multiple curve crystal shape is formed. The additional electrodes 41 may be arranged in rows or areal. Instead of a positive potential, the additional electrodes 41 may also be biased with a negative potential.

In the lower part of FIG. 4, two examples of a location location-selective substrate coating with a plasma crystal manipulated according to the invention are schematically shown. If formation of the plasma crystal is performed in such a manner that the crystal cross section shape shows curvatures pointing upwards, then approximation of the plasma crystal to the substrate 30 according to the above mentioned first or second alternative leads to a coating pattern according to the lower, left part of FIG. 4. If reciprocally a curvature pointing downwards (due to negative potentials of the additional electrodes 41) is set, then the reciprocal approximation leads to island-shaped coating according to the lower, right part of FIG. 4.

Due to suitable shaping of electrode structuring or of the additional electrodes, it is possible to form any coating patterns, for instance in the shape of circles, rings, arches, stripes or similar on the substrate surface. Additional modifications are possible if the additional electrodes are movably arranged according to FIG. 4, so that manipulation of the plasma crystal 40 may be varied over the course of time. Accordingly, different coating patterns may be subsequently applied to the substrate 30.

An alternative design for location-selective deformation of the field between the electrodes is hereinafter explained under reference to the FIGS. 5 to 8.

Figure 5:
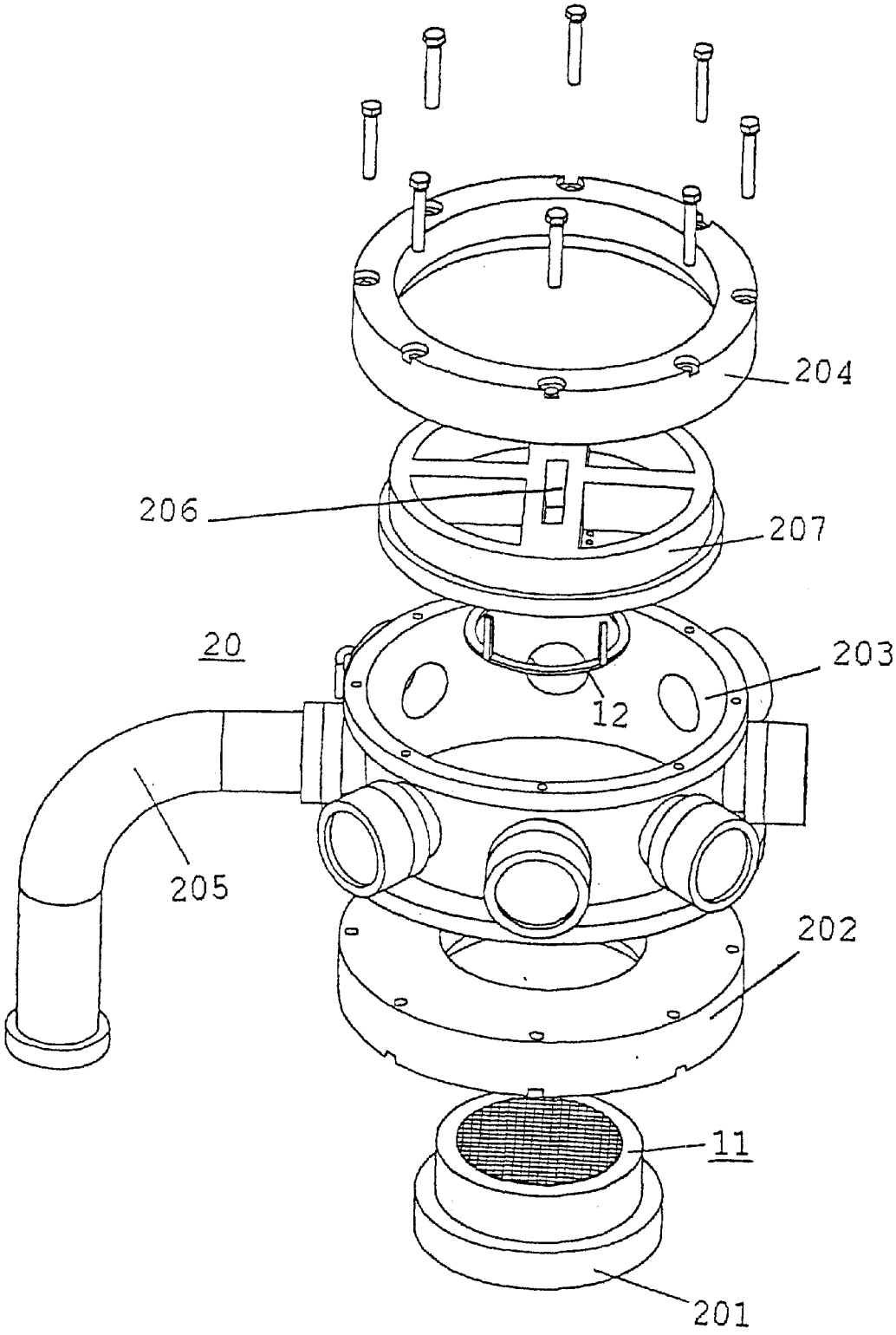
FIG. 5 an exploded view of a reaction vessel with an adaptive electrode according to the invention.

FIG. 5 shows an exploded view of a reaction vessel 20 adapted for implementation of the invention. The reaction vessel 20 is not only adapted for the adaptive electrode described below, but may also be realized in connection with the designs of the invention shown in the other Figures. The reaction vessel 20 consists of an electrode seat 201, which is embedded in the container bottom 202. The reaction space is enclosed by the container bottom 202 with electrode seat 201, the container wall 203 and the container cover 204, and may be evacuated using the vacuum connection 205. The container cover 204 has an inserted window 206, which is mounted on a subunit 207 of the container cover 204, which may be swiveled vacuum-tight with respect to the container cover 204. It may be provided for that the subunit 207 itself may be swiveled under vacuum. The window insert 206 is designed for accommodating different monitoring or diagnosing means for the particles manipulated within the reaction chamber. The parts of the reaction vessel 20 are connected in the usual manner as for a vacuum vessel. Furthermore, through lateral flange units, additional different diagnostic units may be introduced.

FIG. 5 furthermore shows the adaptive HF electrode 11 and the grounded counterelectrode 12 (compare FIG. 1). The counterelectrode,12 is of ring-shaped design to form a viewing opening for the monitoring means (not shown).

Figure 6:
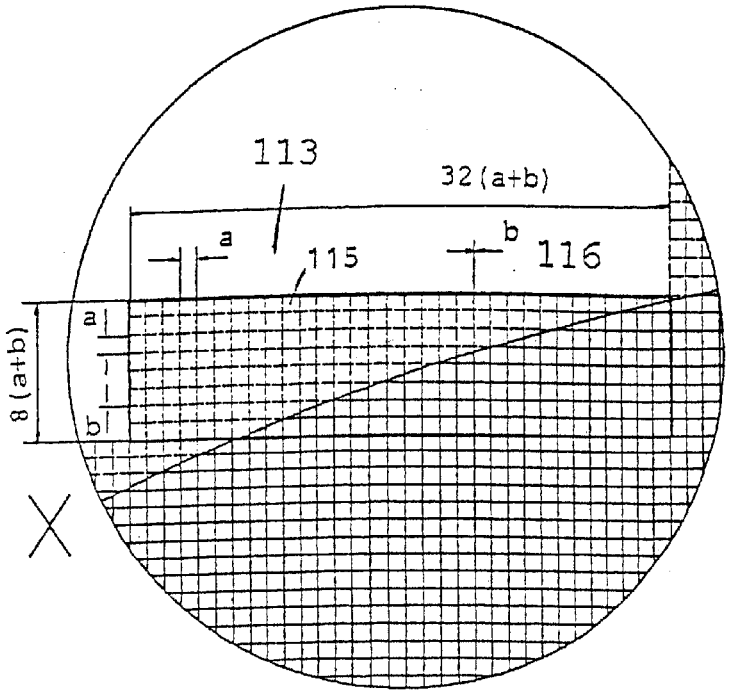
FIG. 6 a schematic top view onto an adaptive electrode according to FIG. 5.
Figure 6:
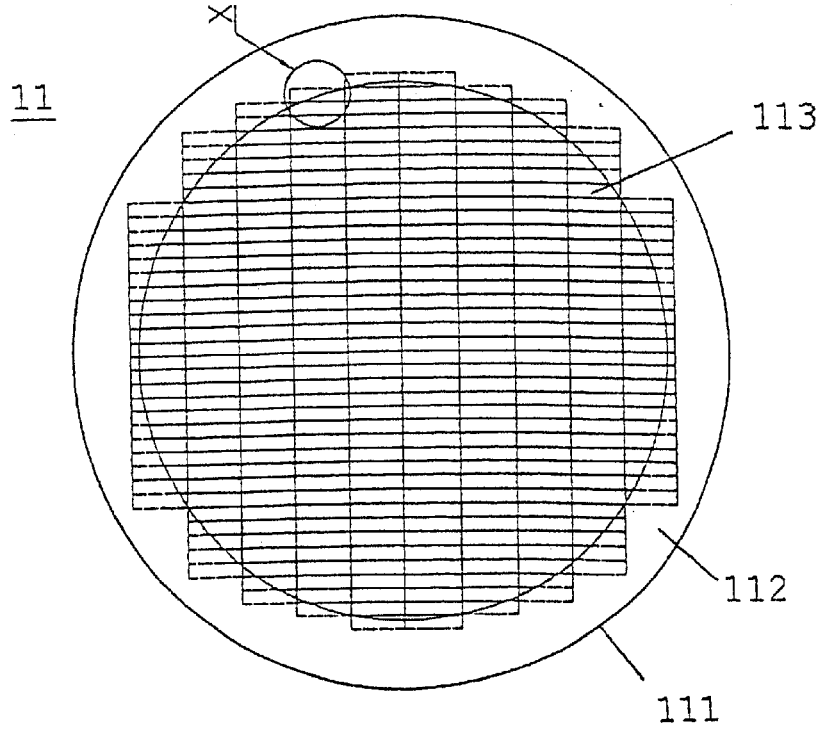

An enlarged top view of the adaptive electrode 11 is shown in FIG. 6. The adaptive electrode 11, according to the usual cylinder shape of vacuum vessels for formation of a field shape undisturbed by external container installations, has an essentially circular edge 111. The edge contains a ring electrode 112 and numerous electrode segments, which for the example shown are compiled in electrode subunits 113. The ring electrode 112 is shown as continuous electrode section made of an integral piece and set up for field correction (flattening) of the electrical field of the high segment electrode section.

Alternatively, it is also possible to provide for a segmented electrode section instead of the ring electrode 112, in which the segments are biased with identical fields. In the transitional section between the electrode subunits and the ring electrode, the subunits are modified in their height in such a manner that the ring (possibly milled out from below) may be pushed over the subunits.

The electrode subunits 113 are provided for in an internal section of the electrode 11, surrounded by the ring electrode 112, and each submit including numerous electrode segments. The shape, size and number of electrode segments is designed application-dependent under consideration of the spatial requirements made of an electrical direct or low frequency field (E) between the electrodes 11, 12 (compare FIG. 1). The largest variability of the adjustable field shape is achieved by a matrix arrangement of numerous point-shaped electrode segments (hereinafter referred to as point segments or point electrodes). In this respect, the designation point-shaped electrode segment respectively point segment means that each electrode segment has a limited area facing to the reaction chamber, but this has substantially smaller dimensions than the total size of electrode 11. For instance, each point electrode has a characteristic length dimension being smaller by a factor of about 1/500 to 1/100, for instance 1/300 with respect to the outside dimensions (diameter) of the electrode 11. The matrix grid may be selected larger depending on the application. In the case of the point grid shape of the adaptive electrode shown here, a characteristic length dimension of the point electrode is preferably equal to or smaller than the Debye length of the particles within the plasma (for instance about 3 mm).

An adaptive electrode 11 for instance has an outside diameter of about 50 cm at a width of the ring electrode 112 of about 5 cm, so that the inner section of the electrode segments 113 has a diameter of about 40 cm. The adaptive electrode subunits 113 may in total for instance include about 50,000 to 100,000 point segments. A preferred measure for segmenting is a 1.27 mm grid compatible to available 1/20 inch plug installations, as these are explained in greater detail with reference to FIG. 7. In this case, about 80,000 point segments electrically insulated from each other may be arranged within the ring electrode 112.

For reasons of clarity, the lower part of FIG. 6 does not show every single point segment, but the electrode subunits (point segment groups). Groupwise combination of point segments is not a compelling characteristic of the invention, but has advantages in electrode control, as this explained in detail below with reference to FIGS. 7 and 8. For instance, the line pattern in the lower part of FIG. 6 by example shows the electrode subunits 113, which in each case contain 8·32 point segments. This is clarified by the upper part of FIG. 6, showing an enlargement of a section (X) of the edge of the electrode subunits 113. The invention is not limited to combining 8·32 point segments into one electrode subunit, but may, depending on construction and application, include other groupings (for instance 16·16 point segments).

The upper part of FIG. 6 by example shows highlighted an electrode subunit 113 with a plurality of point segments or point electrodes 115, which in each case are electrically separated from each other by means of insulation webs. The point electrodes 115 have square faces of the width a=1.25 mm pointed to the reaction chamber. The insulating stems 116 have a width b=0.02 mm, so that in total the above mentioned 1.27 mm grid results. The electrode subunit 113 for instance includes 8·32 point electrodes 115. It may furthermore be seen from FIG. 6 that the ring electrode 112 and the section of the electrode subunits 113 reciprocally overlap. This achieves an optimum, dense filling of the internal sector of electrode 11 even at the edge of ring electrode 112, as this can be seen in the enlarged part of FIG. 6.

The ring electrode 112 as well as the electrode subunits 113 consist of a metallic electrode material. The material for the electrode is selected application-dependent and according to the desired production procedure. In the case of the etching process described below, for instance stainless steel, aluminum or copper may be used as the electrode material. To avoid electrical interference by deposits on the electrode surface, this is preferably coated with an insulating layer, which may for instance consist of the same insulating material as the insulating webs 116. The insulating layer may for instance have a thickness of about 10 $\mu$m to 100 $\mu$m, preferably 20 $\mu$m. Any material is suited as insulation material for the insulation webs 116, which ensures sufficient insulation strength between the point electrodes for the voltages occurring. This insulation material is for instance epoxy resin or another suitable plastic material.

Figure 7:
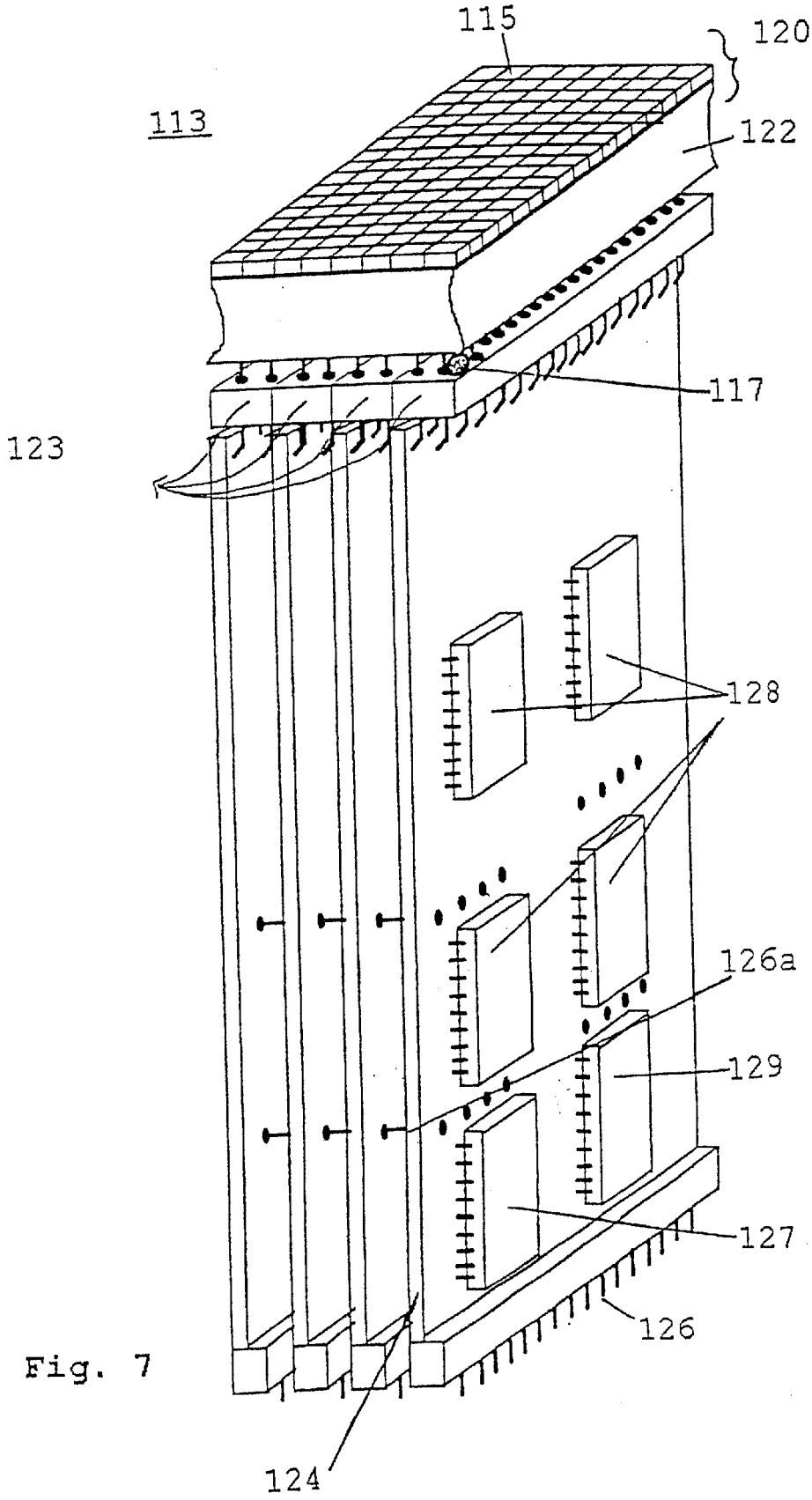
FIG. 7 a schematic perspective view of a subunit of the adaptive electrode shown in FIGS. 5 and 6 including associated switching electronics.

FIG. 7 shows the composition of the segmented electrode by example of an electrode subunit 113. According to the example explained above, the electrode subunit 113 in turn by example includes 8·32 point electrodes 115. These form (together with the other segments not shown of the adaptive electrode) an upper electrode section which is also referred to as segmented electrode 120. The segmented electrode furthermore consists of the insulation plate 122, in which a plurality of sockets is embedded (not shown), whose quantity and arrangement in each case corresponds to the point electrodes 115 of the electrode subunit 113. The sockets are provided for accomodation of the plug units 123, which possibly may also take the form of an integrated baseplate. It is also possible to install the plug units 123 as sockets and to make an electrical connection to the sockets integrated into the insulation plate to create conductive pins. There is an electrical connection between each socket of the insulating plate 122 and the corresponding point electrode 115. The composition of the insulating plate 122 depends on the production process for the overall electrode 11 respectively for the section of the electrode subunits 113. Such a production process is shown below by example.

At first, from the lower side of the insulation plate 122, a drill hole is made for each point electrode 115 through the insulating plate 122 up to the later position of the respective point electrode 115, so that at the end of each point-shaped electrode, which is fastened to the insulating plate using conductive glue, an associated socket accommodating a pin of the plug-in device 123 is created. Then, a metallic plate or film made of the selected electrode material with the desired outside diameter respectively thickness parameters is glued to a plate made of insulating material with a thickness corresponding to the desired thickness of the insulating plate 122. Then material ablation is performed from the metallic electrode film to form the point electrodes 115, whereby the corresponding positions of the point electrodes are situated above the holes in the insulating plate. For material ablation, channel-shaped free spaces according to the pattern of the insulating webs 116 (compare FIG. 6) are formed. This material ablation is by example performed by a masked etching process, during which the metallic film is removed through to the insulating plate except in the desired positions of the point electrodes. Then, the channels for formation of insulating webs 116 are filled using an insulating material. This may for instance be performed by filling using hardening resin.

In a case of alternative procedures, using corresponding structuring procedures, sockets are formed in the insulating plate 122, which in each case in the direction of the adaptive electrode are closed and electrically connected to the respective point electrode 115. In any case, the segmented electrode forms a vacuum-tight end of the reaction chamber.

On the side of the plug units 123 looking away from the segmented electrode, boards 124 are mounted bearing the connecting plugs 126 to external electronics and addressing, decoder, multiplex and demultiplex circuits 127, 128, 129, respectively, whose function is explained below in detail under reference to FIG. 8. For the embodiment of the invention displayed, four plug units 123 (including the boards 124) for in each case 2·32 point electrodes 115 are combined in one MUX module each for control of 8·32 point electrodes. The distance of the four corresponding boards 124 is determined by the reference grid and is slightly larger than the height of the superimposed circuits 127, 128, 129. This dimensioning may in turn be modified depending on size and application. The four boards 124 are connected to each other by partially conductive stabilizing units 126*a*.

For easier handling (fitting of the segmented electrode with plug units), it is possible to provide for color coding 117 on the lower side of the insulating plate 122 for each electrode subunit 113. The boards 124 are designed in such a manner that the electronic switching components shown in FIG. 8 may be integrated.

In the following description, the electrical control of the adaptive electrode 11 according to the invention is explained with reference to the block diagram according to FIG. 8. FIG. 8 shows, in the reaction vessel 20 (see FIG. 5), point electrodes 115 as part of the HF electrode (adaptive electrode 11) and the counterelectrode 12 (also see for instance FIG. 1). Of the (in total 256) point electrodes 115 of an electrode subunit 113, the first and last point electrode of the first and fourth board 124 are in each case shown enlarged (matrix positions (1,1), (2,64), (7,1), (8,64). Furthermore, the ring electrode 112 is shown.

The electronics section 130 includes all boards 124 (see FIG. 7) allocated to the point electrodes 115. By example, a board 124 for 8·32 point electrodes 115 is shown. The electronics section 130, being the reverse side of the adaptive electrode 11 looking away from the reaction chamber, is subject to a vacuum to avoid excess pressure load on the adaptive electrode 11. The pressure in the electronics section 130 may for instance be in the range from 10 to 100 mbar. Alternatively, the electronics section may, as pressure relief for the adaptive electrode, also be filled using an insulating liquid, like for instance oil, which also may assume a cooling function. Separated from the electronics section 130 are under atmospheric conditions supply circuits 140 and a control device 150 provided for. The supply circuits 140 include an HF generator 141, a power supply circuit 142 for the ring electrode 12 and a control voltage circuit 143.

The board 124 has a coupling circuit 131 for each of the point electrodes 115. The coupling circuit 131 is provided for biasing each point electrode (respectively generally each electrode segment) of the adaptive electrode 11 simultaneously with the output voltage of the HF generator 141 and with segment-specific output voltage of the control voltage circuit 143. According to the invention, the fact is exploited with special advantage that the HF supply is a high frequency signal and the location-selective creation of field distribution in the reaction chamber is with low frequency signal respectively using a static electrical field. For instance, the output parameters of the HF generator 141 have an output frequency in the MHz range (corresponding to the usual frequencies for creation and maintaining plasma, for instance 12 to 15 MHz), and a voltage range of ±150 $V_{SS}$ (sine shaped). Contrary to this, bias for the point electrodes 115 is performed by low frequency (≦100 Hz) or static (direct voltage, DC) control voltages. Accordingly, each coupling circuit 131 contains a capacitor-resistor combination (C1–C256, R1–R256), whereby the HF performance is coupled jointly through all capacitors.

Each board furthermore provides for an addressing circuit 132, which includes the above mentioned (see FIG. 7) address decoder, multiplexer and demultiplexer circuits 127, 128, 129, which cooperate as follows.

The address decoding circuit 127 depending on the switching signals (DEMUX CONTROL and MUX CONTROL) of the control circuit 150 selects which voltage is switched by the control voltage circuit 143 including multiplex circuit 128 to a central line 133 using a switching frequency of 256 kHz, and from this using the demultiplex circuit 129 to a coupling circuit 131, again selected by the address decoding circuit 127, according to a point electrode 115. For the embodiment shown, the control voltage circuit 143 supplies 64 control voltages to 64 supply lines (also compare FIG. 8). The control voltages on the power supply bus 143*a* for instance differentiate by voltage steps of 0.625 V and cover the range of ±20 V (direct voltage). Accordingly, the multiplex circuit 128 makes a 1:64 selection for connection of one of the 64 supply lines 143*a* with the central line 133. For the embodiment shown, furthermore 256 coupling circuits 131 according to the 256 point electrodes 115 are provided for, so that the demultiplex circuit 129 makes a 256:1 selection from the central line 133 to one of the coupling circuits 131.

The point electrodes 115 belonging to a board 124 (according to an electrode subunit) are preferably controlled serially according to a certain sequential pattern. In this respect, with special advantage, a dual function of the coupling capacitors C1–C256 is used. These do not only serve coupling of the HF signal, but also maitenance of the electrode potential at the individual point electrodes for as long as according to the serial control sequence there is no connection to the control voltage circuit 143. Because from each point electrode 115 there is a constant current leakage through the plasma, the coupling capacitors C1–C256 must be cyclically recharged to the desired voltage. The coupling capacitors are designed so that the discharge at the respectively coupling capacitor for application-dependent electrode voltages respectively power loss and therefore the voltage loss at the associated point diode during a control cycle is (≦1%) with respect to the electrode voltage.

The switching frequency of the address decoding circuit 127 is selected depending on the number of point electrodes 115 belonging to a subunit 113, on the frequency of the control voltage changes and on the voltage constancy during a cycle at the point electrodes, so that the serial cycle sequence by the subunit or segment group 113 has a substantially higher frequency than the low frequency voltage of the control voltage change. This for instance means in the case of 256 point electrodes and a desired cycle frequency of about 1 kHz (corresponding to 1,000 recharging processes for each point electrodes per second) a switching frequency of 256 kHz. This fast switching between the voltage stages of the control voltage circuit 143 also enables location-selective modelling of the field shape in the reaction chamber 20 according to pulsating field behaviour.

Figure 8:
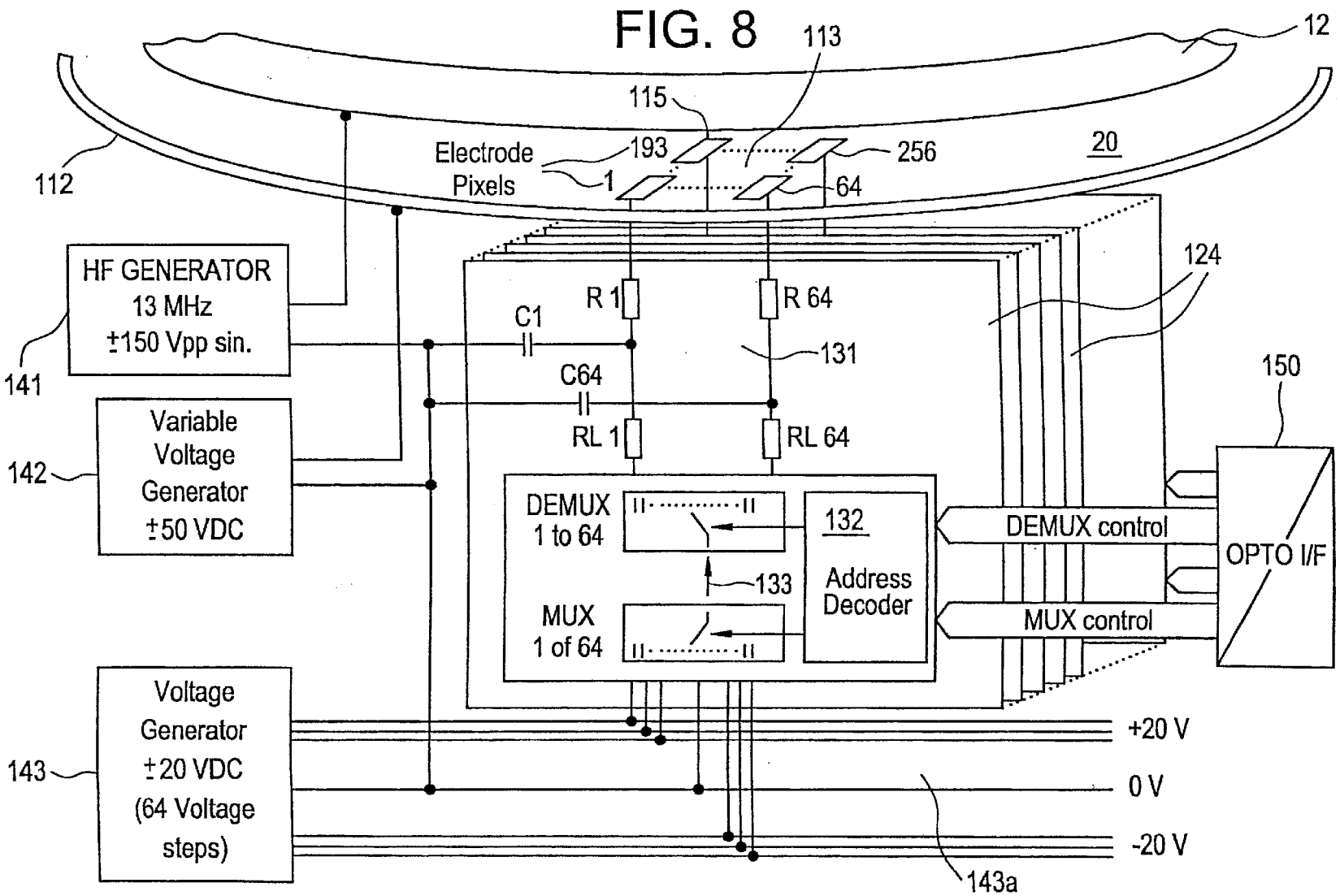
FIG. 8 a block diagram in illustrating of the control electronics of an adaptive electrode according to the invention.

The overall control electronics 140, 150 according to FIG. 8 is superimposed on the HF signal with respect to potential and therefore decoupled from the control computer, the network and other interfaces for cooling purposes, etc. with low capacitance. Input of control signals using a control device 150 is preferably performed using an optical coupler. The adaptive electrode 11 described above and the associated control electronics may be modified as follows. The number, shape and arrangement of electrode segments may be modified depending on the application. When realizing a matrix using point electrodes, the compilation in segment groups may be modified depending on applications. The same holds true for the voltage range of the control voltage circuit 143 and the size of the adjustable voltage steps or stages. Finally, the device in the reaction vessel (see FIG. 5) may be reversed by fitting the grounded electrode 12 on the lower and the HF electrode 11 (especially the adaptive electrode 11) on the upper side.

The most important advantage of the adaptive electrode 11 is creation of a programmable spatial stationary or low-frequency electrical field shape within the reaction chamber, by which charged particles may be held in certain locations or moved in a certain manner. This enable the particles to be manipulated able to be positioned in any manner.

Figure 9:
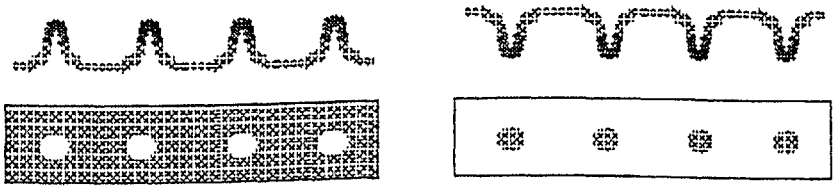
FIG. 9 a schematic illustration of a further example of a location-selective substrate coating.
Figure 9:
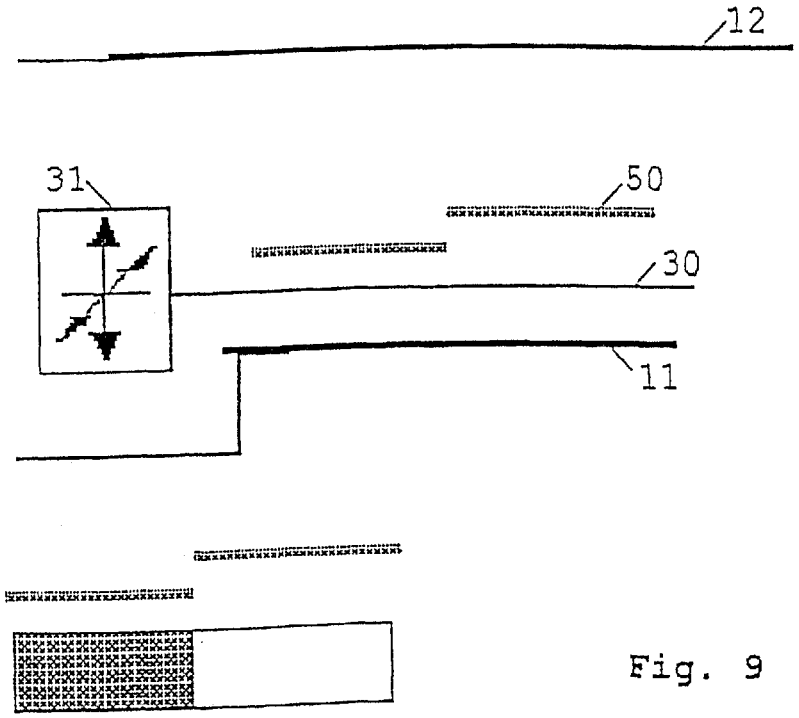

FIG. 9 shows a schematic side view of parts of an embodiment of the invention, in which the plasma crystal 50 is formed between the HF electrode 11 and the substrate 30 with the adjusting device 31 on the one hand and of the counterelectrode 12 on the other is shaped in stages. This plasma crystal shape may for instance be achieved by use of a discharge device according to FIG. 2. By partial irradiation of the plasma crystal using UV rays, some of the particles (in FIG. 9 the left section) are discharged, so that the balance for unchanged plasma conditions is set at a low height above the HF electrode 11. By corresponding modification of the relative position of the plasma crystal 50 and/or the substrate 30, it is possible to achieve partial coating of the substrate 30, as shown in the lower part of FIG. 4.

Figure 10:
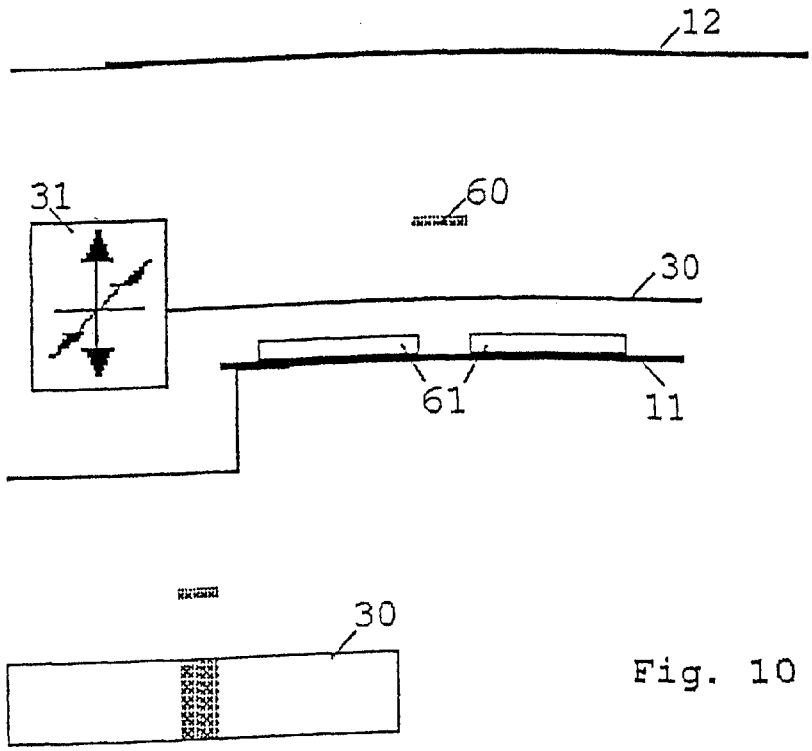
FIG. 10 a representation illustrating a further example of a location-selective substrate coating.

By structuring of the HF electrode 11 using structure elements 61 according to FIG. 10, the electrical field between the HF electrode 11 and the counterelectrode 12 is influenced in such a manner that the plasma crystal is only formed in a section with minimum potential, which is located above parts of the HF electrode 11, which are not covered by the structure elements 61. If the structure elements 61 are for instance formed by covering bars leaving a stripe-shaped gap, then the plasma crystal 60 is stripe-shaped (extension direction vertical to the drawing plane of FIG. 10). The plasma crystal 60 in turn may according to the invention be deposited on the substrate 30. Alternatively to the stripe design according to FIG. 10, the HF electrode 11 may be structured or masked using any structural elements 61.

Figure 11:
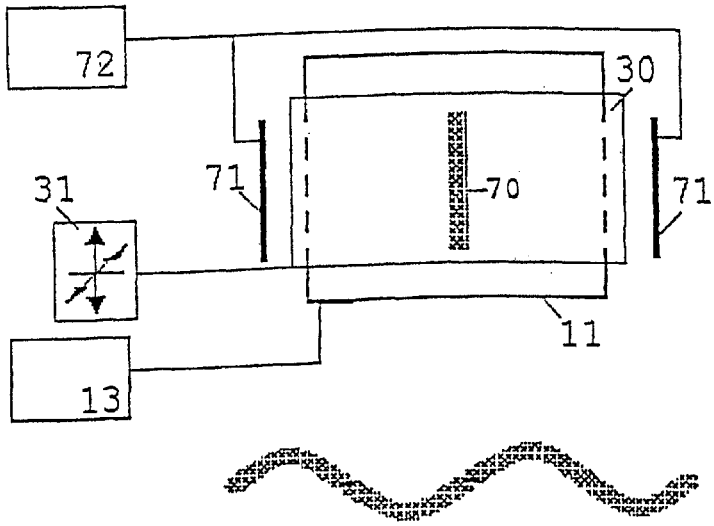
FIG. 11 a schematic top view onto a modified design for manipulating plasma crystals and a further example of a location-selective substrate coating.

FIG. 11 shows an additional possibility for exercising external forces on a plasma crystal. The schematic top view of a design according to the invention shows the HF electrode 11 with the control device 13 and the substrate 30 with the adjusting device 31. The HF electrode 11 bears structure elements (not shown) according to FIG. 10, so that a stripe-shaped plasma crystal is formed. The shape of the plasma crystal 70 may be changed further by synchronously biasing the deflecting electrodes 71 with an alternate voltage. The deflecting electrodes 71 are set up for lateral deformation of a layer-shaped plasma crystal in the layer plane. For instance, snake-shaped oscillation of the particles may be achieved, as shown in the lower part of FIG. 11. This crystal design may in turn be deposited on the substrate 30.

Figure 12:
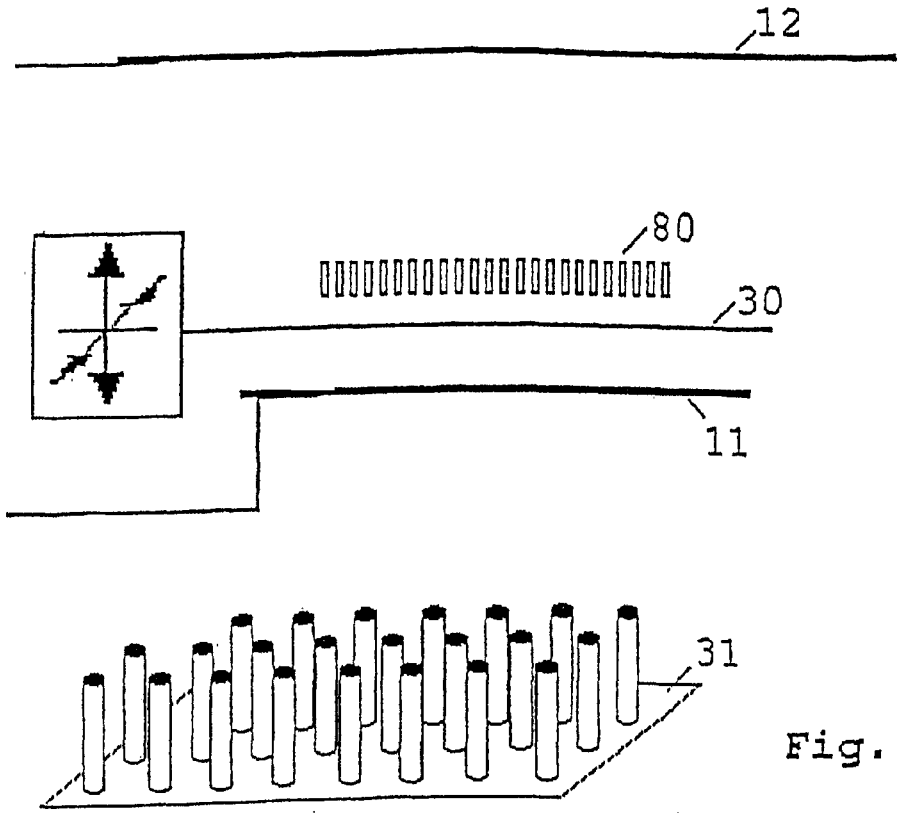
FIG. 12 a schematic illustration of a substrate coating including so-called Bucky tubes.

FIG. 12 shows surface coating using stretched particles, which is especially fitted for achievement of anisotropic optical surface properties. The stretched particles are for instance so-called Bucky tubes (microscopic, tube-shaped particles consisting of a regular arrangement of carbon atoms). The Bucky tubes may for instance have a length of some micrometers and a diameter of about 10 to 20 nm. These particles have a relatively large surface leading to a strong charge within the plasma and to polarization. In the plasma crystal 80, the Bucky tubes are regularly aligned perpendicularly with their length to the planes of the discharge electrodes. By corresponding approximation to the substrate 30, adsorption of the stretched particles is performed with a preferred vertical direction, as shown in the lower part of FIG. 12. These adsorbed substances may possibly be fixed in their position in an additional step using an additional coating.

Figure 13:
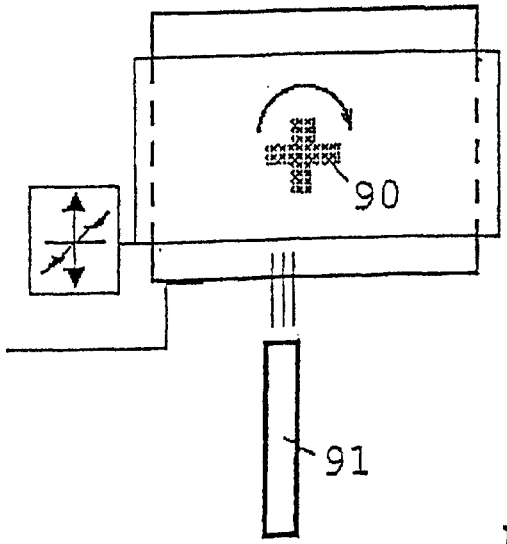
FIG. 13 a schematic top view onto a further design of a device for manipulating plasma crystals according to the invention.

According to FIG. 13 showing a top view of parts of an arrangement according to the invention, manipulating the plasma crystal 90 is also possible by exercising radiation pressure from an external light source 91. The outer control light source may for instance be formed by a helium-neon laser with a power of about 10 mW. The radiation pressure exercised on the particles using the laser beam allows precise position control which may be monitored using a monitoring device 17 (see FIG. 1). Using the radiation pressure, a plasma crystal may be preferably turned (see arrow), or moved onto a substrate located on laterally.

Besides the embodiments of the invention shown, further modifications of the arrangement according to the invention are conceivable by device of means by which in exercising external forces the conditions of a plasma crystal may be location-selectively changed. For instance, it is possible to achieve an additional magnetic field device for deliberate control of the plasma, for instance by a magnetic field direction aligned vertically with respect to the electrode planes. It is furthermore possible to dynamically perform the coating procedure, whereby particles are continuously introduced into the plasma space and after arrangement as plasma crystal are location-selectively applied to the substrate surface. Further modifications refer to the substrate. The substrate does not have to be planar, but it may have a curved surface. It is possible to have several substrates. It is also possible to operate a device according to the invention without application to a substrate as a display device, in which anisotropic particles may be switched between different orientations for display of predetermined patterns, which for instance each represent a condition "blackening" or "transparency". It is also possible to manipulate particles of different sizes at different heights of a plasma and laterally illuminate them using the exciting light sources of different wavelengths, so that color displays with high resolution could be created.

A specific advantage of the invention is that it may be realized by inexpensive modification of traditional plasma reactors (for instance from the circuit manufacture), whose operating conditions are well known and under control. The invention may be used for manufacture of so-called designer materials with specific surface properties.

What is claimed is:

1. A method of manipulating particles in a plasma of a carrier gas within a reactor vessel having high frequency electrodes and a substrate arranged between said electrodes, said method comprising:

forming a plasma crystal comprising said particles in a plasma-crystalline state, said particles being held in a balance between gravitational and electrical forces, wherein said substrate is arranged between said plasma crystal and one of said electrodes, modifying the shape of said plasma crystal by location-selective effecting said balance between gravitational forces and electrical forces, and arranging and adhering at least a portion of said particles on said substrate by one or more selected from the group consisting of influencing the electrical forces holding the particles, moving the substrate and modifying plasma conditions in said vessel so as to retain at least a part of the modified plasma crystal on the substrate.

2. The method according to claim 1, in which said particles have an elongated bar shape and are arranged on said substrate so that said elongated shape is substantially vertical on said substrate.

3. The method of claim 1, wherein said particles are used for coating said substrate.

4. The method according to claim 1, wherein said balance is effected by location-selective particle discharging or by light radiation pressure.

5. The method according to claim 4, wherein said particle discharge is performed by location-selective UV radiation of particles in the plasma-crystalline state.

6. The method according to claim 1, wherein said modification of plasma conditions includes one or more selected from the group consisting of changing plasma pressure, plasma temperature, carrier gas, plasma energy and/or operating frequency of the plasma and switching of plasma creation.

7. The method according to claim 1, wherein said influencing of electrical forces includes adjusting an electric field to arrange said particles along a predetermined curved surface or in a delimited area.

8. A method of manipulating particles in a plasma of a carrier gas within a reactive vessel having high frequency electrodes, said method comprising:

forming a plasma crystal comprising said particles in a plasma-crystalline state, said particles being held in a balance between gravitational and electrical forces, moving a predetermined portion of said plasma crystal to a treatment position by location-selective effecting said balance between gravitational forces and electrical forces or by modifying said plasma conditions, and subjecting said particles in said treatment position to a plasma treatment comprising a particle surface coating or ablation.

9. The method according to claim 8, wherein said particles are adhered onto a substrate arranged between said electrodes after said plasma treatment, said adhering comprising moving said particles in relation to said substrate by influencing electrical forces holding said particles and moving the substrate or a modification of plasma conditions in said vessel until the particles at least partially adhere to the substrate.

10. The method according to claim 8, wherein said predetermined portion of said particles is moved by location-selective particle discharging or light radiation pressure.

11. The method according to claim 10, wherein said particle discharging is performed by location-selective UV irradiation of said particles.

12. The method according to claim 8, wherein modification of said plasma conditions includes one or more selected from the group consisting of a change in plasma pressure, plasma temperature, carrier gas, plasma energy, and/or operating frequency of the plasma; switching off plasma creation; and influencing an electrical field applied to said particles.

13. The method according to claim 12, wherein said influencing of said electrical field includes adjusting a static electric field to arrange said particles along a predetermined curved surface or in a predetermined area.

14. The method according to claim 9, in which said particles have an elongated bar shape and are arranged on said substrate so that said elongated shape is substantially vertical on said substrate.

15. The method according to claim 8, wherein said particles are arranged to form a geometrical shape.

16. The method of claim 8, wherein said particles are formed into a display.

17. The method according to claim 16, wherein said particles are anisotropic particles switched between different orientations by a change of said plasma conditions to display predetermined patterns.

18. The method according to claim 16, wherein said particles are positioned in predetermined locations in said plasma and illuminated laterally with excitation light sources of different wavelengths so that said display forms a colored display.

19. A method of manipulating particles in a plasma of a carrier gas subject to plasma conditions, comprising the steps of:

arranging said particles in a plasma-crystalline state, said particles being held in a balance between gravitational and electrical forces, subjecting a predetermined portion of said particles to a plasma treatment comprising a particle surface coating or ablation, and collecting said particles being subjected to said plasma treatment on a substrate.

20. The method according to claim 19, wherein said predetermined portion of said particles are moved to a treatment position by one or more selected from the group consisting of adjusting forces influencing said balance between gravitational and electrical forces and modification of plasma conditions.

21. The method according to claim 20, wherein said adjusting of forces is applied by location-selective particle discharging or by light radiation pressure.

22. The method according to claim 21, wherein said particle discharging is performed by location-selective UV radiation of particles in the plasma-crystalline state.

23. The method according to claim 21, wherein said modification of plasma conditions includes one or more selected from the group consisting of changing plasma pressure, plasma temperature, carrier gas, plasma energy and/or operating frequency of the plasma; switching of plasma creation; and location-selective influencing an electrical field on said particles.

24. The method according to claim 23, wherein said influencing of said electrical field includes location-selective adjusting of said electric field to arrange said particles along a predetermined curved surface or in a delimited area.

25. A method of manipulating particles in a plasma of a carrier gas within a reactor vessel having high frequency electrodes, said method comprising the steps of:

forming a plasma crystal comprising said particles in a plasma-crystalline state, said particles being held in a balance between gravitational and electrical forces, and moving a predetermined portion of said particles by location-selective effect said balance between gravitational forces and electrical forces or by modifying said plasma conditions, wherein the shape of said plasma crystal is modified to change the crystalline structure so that predetermined patterns are displayed with said particles arranged in said plasma-crystalline state.

26. The method according to claim 25, wherein said particles have an elongated bar shape and said plasma conditions are changed such that the said predetermined portion of said particles are switched between different particle orientations so that a predetermined pattern is displayed by said particles.

27. The method according to claim 25, wherein said particles are positioned in predetermined locations in said plasma and illuminated laterally with excitation light sources of different wavelengths, so that a coloured display is formed.

28. A method of manipulating particles in a plasma-crystalline state in a plasma of a carrier gas within a reactor vessel comprising the steps of:

applying a motive force to said particles; and using said motive force to arrange at least a portion of said particles into an elongated bar shape that is substantially vertical on a substrate inserted into said reactor vessel.

29. A method of manipulating particles in a plasma-crystalline state in a plasma of a carrier gas within a reactor vessel comprising the steps of:

applying a motive force to said particles;

subjecting said particles to a plasma treatment under predetermined plasma conditions; and using said motive force to arrange at least a portion of said particles into an elongated bar shape that is substantially vertical on a substrate inserted into said reactor vessel.

30. A method of manipulating particles in a plasma-crystalline state in a plasma of a carrier gas within a reactor vessel comprising the steps of:

applying a motive force to said particles;

subjecting said particles to a plasma treatment under predetermined plasma conditions; and forming said particles into a display, wherein predetermined patterns are displayed within anisotropic particles switched between different orientations by a change of said plasma conditions.

* * * * *